US006755757B2

(12) United States Patent
Sutherland

(10) Patent No.: US 6,755,757 B2
(45) Date of Patent: Jun. 29, 2004

(54) COMPOSITE OVER-WRAPPED LIGHTWEIGHT CORE AND METHOD

(75) Inventor: Terrance W. Sutherland, Ottawa (CA)

(73) Assignee: CE Composites Baseball Inc., Ottawa (CA)

( * ) Notice: Subject to any disclaimer, the term of this patent is extended or adjusted under 35 U.S.C. 154(b) by 0 days.

(21) Appl. No.: 09/862,254

(22) Filed: May 22, 2001

(65) Prior Publication Data

US 2001/0046910 A1 Nov. 29, 2001

Related U.S. Application Data

(63) Continuation-in-part of application No. 09/040,775, filed on Mar. 18, 1998, now abandoned.

(51) Int. Cl.[7] ..... A63B 59/06
(52) U.S. Cl. ..... 473/566; 473/567
(58) Field of Search ..... 473/564–568, 473/457, 519, 520

(56) References Cited

U.S. PATENT DOCUMENTS

| | | | | |
|---|---|---|---|---|
| 1,121,189 A | | 12/1914 | Lincoln | |
| 2,944,820 A | | 7/1960 | Paullus | |
| 3,129,003 A | | 4/1964 | Mueller et al. | |
| 3,184,236 A | | 5/1965 | Zens | |
| 3,433,481 A | | 3/1969 | Tanguay | |
| 3,598,410 A | | 8/1971 | Costopoulos | |
| 4,014,542 A | | 3/1977 | Tanikawa | |
| 4,373,718 A | | 2/1983 | Schmidt | |
| 4,505,479 A | * | 3/1985 | Souders | 473/566 |
| 4,763,900 A | | 8/1988 | Carr | |
| 4,848,745 A | | 7/1989 | Bohannan et al. | |
| 4,923,541 A | | 5/1990 | Burger | |
| 4,981,737 A | | 1/1991 | Rico | |
| 5,077,106 A | | 12/1991 | Dursch et al. | |
| 5,165,686 A | | 11/1992 | Morgan | |
| 5,395,108 A | | 3/1995 | Souders et al. | |
| 5,458,330 A | | 10/1995 | Baum | |
| 5,904,803 A | * | 5/1999 | Hillerich et al. | 156/494 |

OTHER PUBLICATIONS

Wood Handbook, Wood as an Engineering Material, Forest Products Society, 1999, pp. 3–11 through 3–14; 4–9 through 4–11 and 4–20 through 4–23.

Worth Catalog, *America's Baseball/Softball Company,* 1990/91, pp. WCE00001 to WCE00031.

* cited by examiner

*Primary Examiner*—Mark S. Graham
(74) *Attorney, Agent, or Firm*—Greer, Burns & Crain, Ltd.

(57) ABSTRACT

A baseball bat having a lightweight core comprised of an elongated handle portion and a striking portion, wherein the handle portion and/or the striking portion is/are over wrapped with a singular thin external polymer composite skin bonded with resin directly and rigidly to the core forming a structural sandwich resulting in reduced weight, improved strength, stiffness and durability, thereby providing increased bat speed and improved hitting distances.

10 Claims, 7 Drawing Sheets

COMPOSITE OVER-WRAPPED LIGHTWEIGHT CORE AND METHOD

This is a Continuation-In-Part of U.S. patent application Ser. No. 09/040,775, filed Mar. 18, 1998 abandoned.

FIELD OF THE INVENTION

The present invention relates to game device and tool handle lightweight cores and more particularly to composite over-wrapped lightweight wooden, metal and foam cores.

BACKGROUND OF THE INVENTION

In many types of sports equipment, such as baseball, hockey and lacrosse, for instance, the handle portion thereof is usually made of a hard, smooth material such as wood or aluminum. consequently, the handle becomes slippery when in the course of the game moisture from the hands of the user coats the handle surface.

Friction tape which makes use of a porous cloth which is permeated by adhesive has commonly been used by athletes. This characteristic stickiness gives the handle an unpleasant feel and furthermore does little to cushion the hands against shocks resulting from the contact of the sports equipment with the object to be hit.

Furthermore, it has been found difficult in practice to decrease the overall weight of sports equipment since it would lead to weaker and less stiff equipment thereby resulting in breakage and lower performance standards.

It should also be noted that a baseball bat made of wood, for instance, has a relatively small "sweet zone" where the contact of the baseball with the bat will result in maximum energy transfer.

Baseball bats have traditionally been made of wood. Today, wood baseball bats are all made of heavy and strong hardwoods, primarily ash. Ash (or other similar hardwoods such as hickory or birch) baseball bats result in bats where the rule of thumb is the length in inches equals the weight in ounces. Thus, today's wood baseball bats limit bat speed and also, are prone to catastrophic breakage. Such catastrophic breakage could lead to injury of not only players but also to bystanders and are a real concern to authorities. Also, as wood bats dry out (i.e. loose moisture), they lose strength and breakage increases.

The following is a comparison of the densities of various types of hardwoods and softwoods based on weight when oven dry and volume at 12% moisture content, taken from data contained in the Wood Handbook—Wood as an Engineering Material, published in 1999 by Forest Products Society of Madison, Wis.:

| | Density lb/ft$^3$ |
|---|---|
| Hardwood | |
| Hickory, true Mockernut | 50.3 |
| Yellow Birch | 43.3 |
| White Ash | 41.9 |
| Paper Birch | 39.1 |
| Yellow Poplar | 29.4 |
| Aspen Bigtooth | 27.3 |
| Aspen Quaking | 26.6 |
| Softwood | |
| Fir Balsam | 24.5 |
| Cottonwood-Balsam poplar | 23.8 |
| Balsa | 11.2 |

Density of wood is generally proportional to strength and stiffness. For example yellow poplar is 30% lighter than white ash with a corresponding decrease in strength. Hardwoods are both stronger and stiffer than softwoods and, most importantly, they are more impact resistant than softwoods. Only hardwoods have the required strength and impact resistance for baseball bats of the invention.

More recently, aluminum baseball bats have captured a large majority market share versus wood bats, even though they are more expensive and players complain about vibrations and the "pinging" sound when a baseball is hit. There are two reasons for the aluminum bat's success: 1) they are lighter than wood baseball bats, thus increasing bat speed and increasing hitting distance, and 2) they are less prone to breakage than wood bats.

Most recently, in an attempt to further lower weights of aluminum bats, thinner walled aluminum bats have been produced; however, problems have been encountered with balls leaving depressions in the bat and also, bat breakage.

U.S Pat. No. 4,014,542, which issued to Tanikawa on Mar. 29, 1977, describes a five component baseball bat having a softwood balsam core, a main member made of foam, a metal tube having apertures for bonding fixed to the barrel portion only of the main member, and an outer layer of glass fibre which is painted with a synthetic resin. Even though Tanikawa's bat is durable and is designed to reduce the shock caused by contact with a baseball, Tanikawa does not improve hitting performance by reducing the weight of the bat when compared to a conventional bat, while at the same time enhancing bat strength and stiffness. Moreover, the construction of Tanikawa's bat is not a "structural sandwich" which combines a single strong thin composite outer layer with a thick lightweight core to reduce the overall weight of the bat while at the same time enhancing bat strength, stiffness and durability.

U.S. Pat. No. 5,458,330, which issued to Baum on Oct. 17, 1995, describes a multi-component bat having between five and eleven layers. Baum's bat includes external layers of wood veneer over a plurality of resin impregnated fabric socks, which in turn surround inner cores of foam, wood or aluminum which may include cavities. Baum's bat is designed to have the appearance of a conventional wood bat with the objective of being less susceptible to breakage and comparable in performance. Baum, however, does not improve hitting performance by reducing the weight of the bat when compared to a conventional bat, while at the same time enhancing bat strength and stiffness. Neither does the construction of Baum's bat comprise a "structural sandwich" for reducing weight while maintaining or enhancing bat strength, durability and performance.

The following is a specific properties chart showing the density, stiffness and strength properties of various possible materials for use in making baseball bats. All data is taken from standard text books available in the field. Specific stiffness and specific strength are actual stiffness and strength divided by density respectively. Strengths for composite materials are given as tensile strength measured along fiber direction in a unidirectional part. Strength for wood is given as the minimum of tensile and compressive ultimate strength. Strength for metal is given as ultimate tensile strength. Densities of white ash, yellow poplar and bigtooth aspen are taken from the above table of wood densities:

| Materials | Density lbs/ft$^3$ | Stiffness M/SI | Specific Stiffness | Strength K/SI | Specific Strength |
|---|---|---|---|---|---|
| Steel AISI 304 | 487 | 30.00 | 3.90 | 85.00 | 10.90 |
| Aluminum 6061-T6 | 169 | 10.00 | 3.70 | 45.00 | 16.60 |

-continued

| Materials | Density lbs/ft$^3$ | Stiffness M/SI | Specific Stiffness | Strength K/SI | Specific Strength |
|---|---|---|---|---|---|
| Aluminum 7075-T6 | 169 | 10.00 | 3.70 | 83.00 | 30.50 |
| Titanium Ti-75A | 283 | 17.00 | 3.70 | 80.00 | 17.70 |
| High Modulus Graphite | 102 | 38.00 | 23.30 | 165.00 | 100.00 |
| Intermediate Modulus Graphite | 102 | 34.00 | 19.50 | 180.00 | 109.80 |
| Commercial Graphite | 98 | 21.00 | 13.30 | 210.00 | 132.90 |
| E-Glass | 130 | 17.00 | 3.10 | 135.00 | 64.30 |
| S-Glass | 124 | 8.00 | 4.00 | 155.00 | 77.60 |
| Kevlar 49 | 86 | 11.00 | 8.00 | 210.00 | 152.20 |
| White Ash | 42 | 2.00 | 3.00 | 8.00 | 12.10 |
| Bigtooth Aspen | 27 | 1.00 | 2.30 | 4.00 | 9.30 |
| Yellow Poplar | 29 | 1.10 | 2.40 | 4.50 | 9.80 |

Polymer composites are over 16 times stronger than ash and 60% stronger than aluminum. However, they are over three times heavier than ash while approximately 20% lighter than aluminum, those being hollow therefore lighter than solid composite bats, on an equal volume basis. In summary, an all polymer composite baseball bat would be much stronger than either an ash or aluminum bat, but would be much too heavy.

By careful selection and combination of materials of varying densities, strengths and stiffness, such as those listed above, the applicant has been able to achieve weights for various baseball bat models (for example softball, youth, baseball, etc.) that are lower than traditionally constructed bats and that, at the same time, have improved mechanical properties, such as strength, stiffness and durability, and thus improved performance.

The performance, durability and appearance of sports equipments can be dramatically improved by construction of such equipments, with lighter cores over-wrapped by polymer composite.

We shall discuss the invention through its application to a baseball bat but it is understood that it applies to other sports equipment and tool handles as well if applicable.

SUMMARY OF THE INVENTION

In view of the foregoing, a main object of the present invention is to provide a highly frictional surface, uniform in appearance for sports equipment.

More particularly, an object of this invention is to provide a lighter weight, stronger and stiffer sports equipment having a highly frictional and aerodynamic surface.

Also an object of the present invention is to provide an improved dampening structure which acts to minimize vibrations on the hands of the user.

Another object of the present invention is to provide a simple, low cost manufacturing method requiring basically no tooling resulting in improved appearance with no seams or parting lines.

It is still a further object of the present invention to provide a polymer composite over-wrapped lightweight baseball bat.

A further object of preferred embodiments of the present invention is to provide baseball bats that weigh less than similar sized conventional baseball bats, thus resulting in increased bat speed and a corresponding improvement in hitting performance, while at the same time enhancing strength and durability compared to conventional baseball bats.

In accordance with another object of the present invention there is provided a device having a lightweight core including a shaft having a longitudinal handle portion at one end for manipulation by a user during use of the device and a working portion for striking or catching by a user at a second opposite end, said handle portion being over-wrapped with at least one polymer composite sleeve to encircle the outer surface of said handle portion.

In accordance with yet another object of the present invention there is provided a baseball bat having a lightweight core including a shaft having a longitudinal handle portion at one end for manipulation by a user and a striking portion at a second opposite end, the entire baseball bat core being over-wrapped with at least one polymer composite sleeve to encircle the outer surface of the bat whereby performance is enhanced.

In accordance with yet another object of the present invention there is provided a method of over-wrapping a device having a lightweight core including a shaft having a longitudinal handle portion and a working portion comprising the steps of: a) spreading at least one sleeve over at least the handle portion of the core; b) applying a resin to the sleeve; and c) curing; whereby the core is imparted a textured finish improving grip and performance or a smooth surface.

In summary, all embodiments of the present invention provide a "structural sandwich" comprised of a singular thin high strength, high stiffness external polymer composite sleeve or skin covering and rigidly bonded with a highly adhesive resin directly to a singular relatively thick, relatively weak lightweight wood, metal or foam core, the polymer composite sleeve or skin comprising fibers impregnated with resin. The combination forms a "structural sandwich" providing high strength and stiffness, with maximum strength and stiffness to weight ratios achieved by a thin, strong skin and a relatively thick, lightweight core.

Further objects and advantages of the present invention will be apparent from the following description, wherein preferred embodiments of the invention are clearly shown.

BRIEF DESCRIPTION OF THE DRAWINGS

The present invention will be further understood from the following description with reference to the drawings in which.

DETAILED DESCRIPTION OF THE INVENTION

Figure 1:
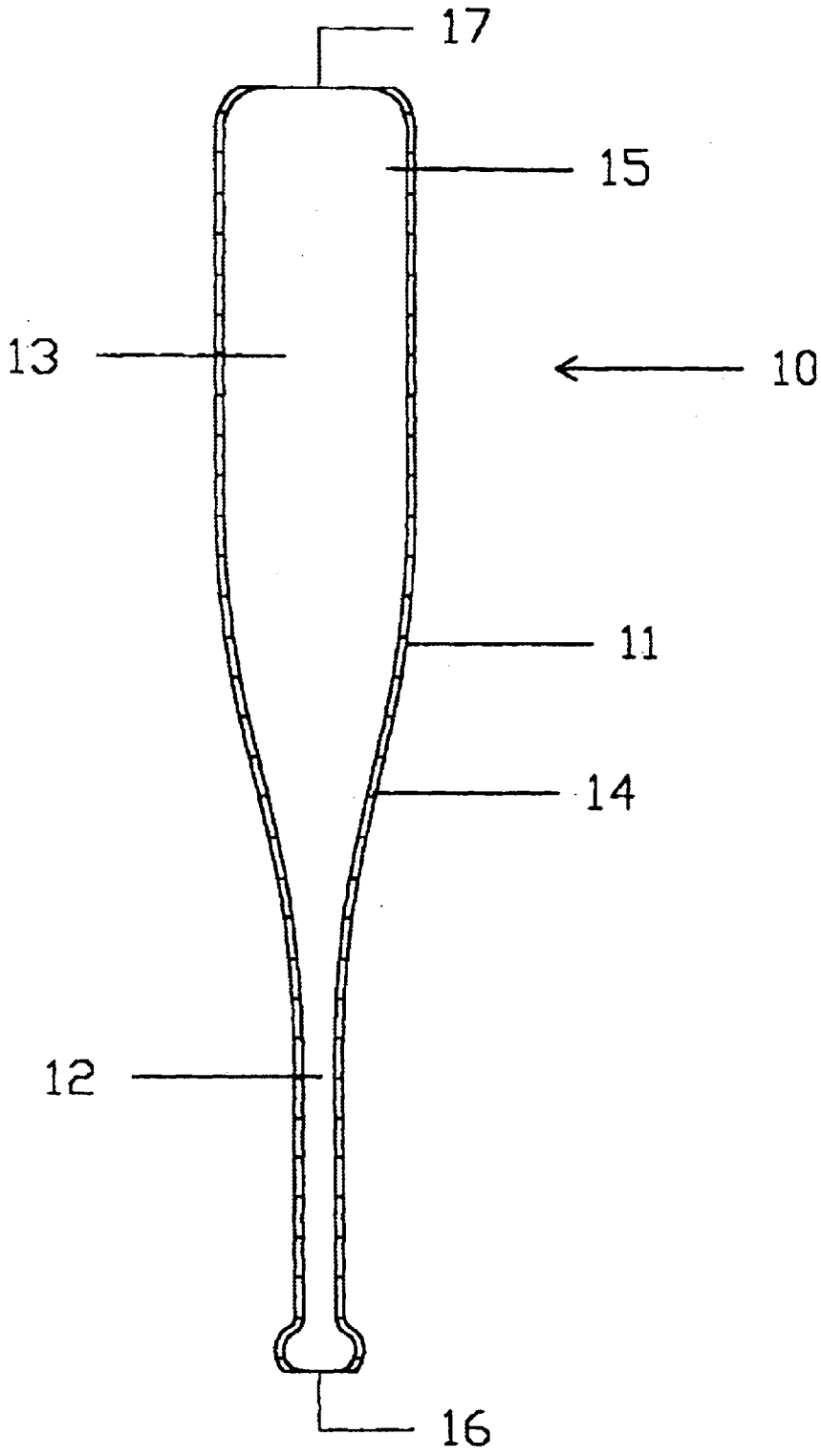
FIG. 1 shows a longitudinal cross-section of one embodiment of a baseball bat in accordance with the invention.
Figure 2A:
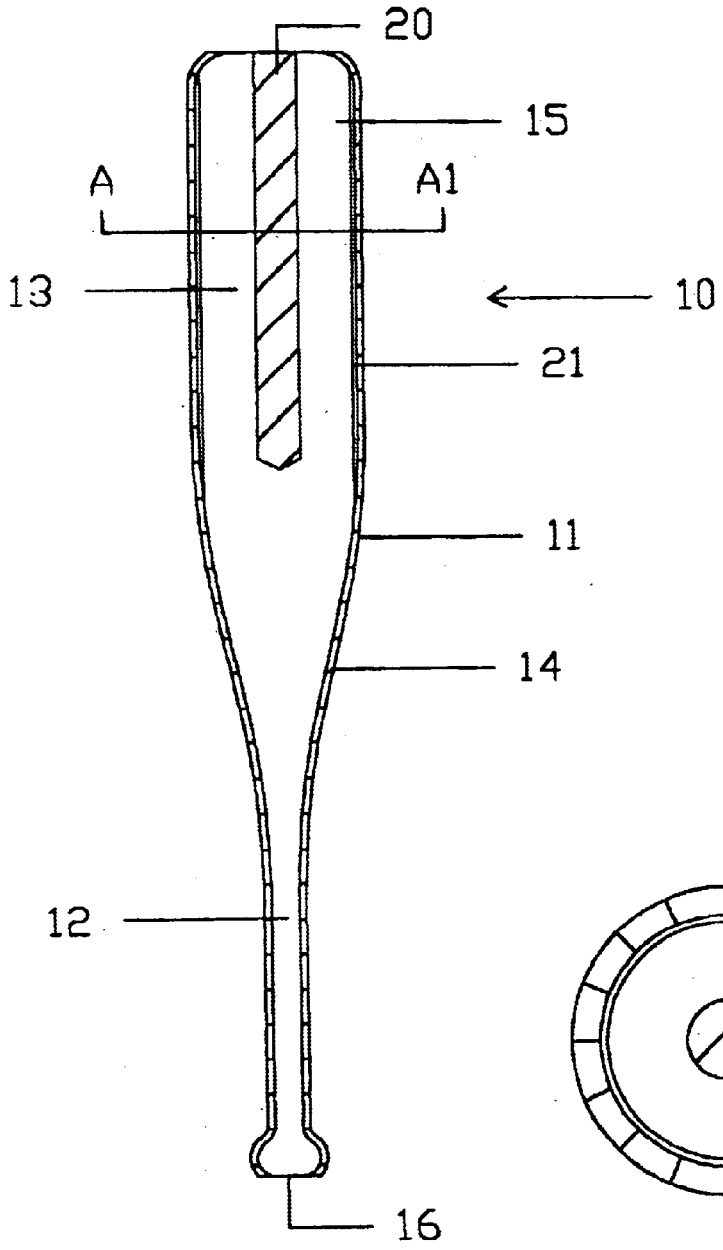
FIG. 2*a*) shows a longitudinal cross-section of a baseball bat with a hollowed out centre and a compressible material in accordance with the invention.
Figure 2B:
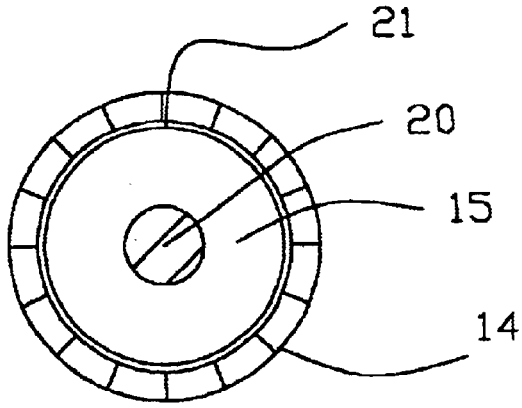
FIG. 2*b*) is a cross sectional view of the baseball bat in accordance with the invention along lines A—A$^1$ of FIG. 2*a*)

A first main preferred embodiment of the invention is the forming and bonding of a fiberglass braid/sleeve over the full length and surface area of a light weight wooden core as illustrated in FIG. 1. The baseball bat, generally 10, is made of lightweight porous aspen or poplar core 15, for instance, machined to a desired shape, be it for adult or youth baseball or softball play, and including a shaft 11 having a longitudinal handle portion 12 at one end for manipulation by the user during play and a working portion 13 for striking (or catching in some other instance, such as lacrosse) by the user at a second opposite end. The light weight core 15 could be made even lighter by hollowing it out 20 as seen in FIGS. 2*a*) and 2*b*).

In the case of the baseball bat 10 it has been found that wrapping the entire length of the device with at least one polymer composite braid, forming a thin sleeve or skin 14 around the device, resulted in a lighter, stronger and stiffer device offering improved dampening thereby reducing vibrations occasioned on contact of the baseball with the baseball bat in this case. It would also be possible to have either the handle end 16 or working portion end 17, or both, not covered by the sleeve 14. The resulting device weighted as low as 22 ounces versus similar sized aluminum bats weighing in at 28 ounces and ash wood bats weighing in at 33 ounces. In general, the resulting baseball bat weighs at least 3 ounces less than the length of the bat measured in inches. That is, a 33 inch bat will weight less than or equal to 30 ounces and so forth.

The structure of the described embodiment shown in FIG. 1 is referred to by those skilled in the art as a "structural sandwich", which is generally comprised of a single relatively thin high stiffness, high strength external skin covering and rigidly bonded directly to a relatively thick, relatively weak singular lightweight core. In this case, the skin is polymer composite 14 and the core is lightweight aspen or poplar 15, but, as described in further embodiments below, core 15 may also be a metal or a foam core or any other suitable lightweight material. The combination forms a "structural sandwich", providing high strength and stiffness with maximum strength and stiffness to weight ratios achieved by a thin, strong skin and a relatively thick, lightweight core.

The following chart illustrates the design advantages of using "structural sandwiches" having the above-described characteristics of a singular thin strong skin bonded to light, thick core:

| | Design 1 | Design 2 | Design 3 |
|---|---|---|---|
| Sandwich Thickness | t | 2t | 4t |
| Skin Thickness | t | t | t |
| Core Thickness | 0 | t | 3t |
| Strength | 1.0 | 3.5 | 9.2 |

-continued

| | Design 1 | Design 2 | Design 3 |
|---|---|---|---|
| Stiffness | 1.0 | 7.0 | 37.0 |
| Weight | 1.0 | 1.03 | 1.06 |

By using a "structural sandwich" like that of Design 2, strength is increased 3.5 times and stiffness 7 times, with only a 3% increase in weight, over the non-sandwich construction of Design 1. In Design 3, a still thinner skin combined with a thicker lightweight core increases strength 9.2 times and stiffness 37 times, with only a 6% increase in weight. Structural sandwich designs are optimized by using a strong lightweight external skin rigidly bonded to opposite sides of a lightweight core, as in the baseball bat of the present invention.

The present invention applies the structural sandwich principle to the construction of baseball bat 10. A thin, high strength, high stiffness, polymer composite skin 14 is rigidly bonded with resin to the exterior of thicker lightweight core 15. Typically, the thickness of polymer composite sleeve or skin 14 is in the range of 0.040 inches around the circumference of core 15 which, for a 2.5 inch diameter bat, has a thickness of 2.42 inches. The result is a bat that is the same size as a conventional bat, yet is much lighter, thereby improving hitting performance, while at the same time having enhanced strength, stiffness and durability.

In the first main embodiment, the selection of two specific low weight hardwoods (aspen or poplar) to form core 15 is critical to providing relatively low weight (as compared to ash), but at the same time providing sufficient stiffness, strength and impact resistance that is higher than any softwood (such as balsa or balsam fir), albeit heavier. Coupled with the singular polymer composite external sleeve or skin 14, a resulting 33 inch bat weighs between 30 and 22 ounces. This is compared to similar sized aluminum bats weighing 28 ounces, and ash wood bats weighing 33 ounces. Hitting performance is therefore enhanced by the resulting faster bat speeds.

It should be noted that the aspen/poplar core in the first main preferred embodiment is a relatively weak porous wood whereby the wet epoxy resin soaks into the porous wood grain resulting in an increasing strength of the wood core and also, ensuring bonding of the polymer composite outer wrap to the inner wood core. Also, the composite over-wrap encapsulates the wood therefore preventing it from drying out and losing strength. To aid in the absorption of resin into the wood core 15, the surface of core 15 can be mechanically roughened prior to application of resin.

This resulted, in experiments conducted with semi-pro baseball players, in faster bat speed which in turn increased hitting distance and therefore also allowing a player more time before reacting to a pitched ball.

A 3 mph increase in bat speed results in 10 feet of additional hitting (ball) distance; the preferred embodiment therefore provided up to 10% increase in bat speed or approximately 30 feet of extra hitting distance.

Also, the 10% increase in bat speed allows the player 10% more reaction time to the pitch. This equates to 6 feet more of pitch length before deciding to swing. This provides significant improved hitting performance in addition to the increased hitting distance. To further increase hitting distance, a compressible material 21 of rubber or foam could be inserted between the composite layer and the inner lightweight core in order to achieve what is commonly known as the "trampoline effect" upon impact of the ball with the baseball ball therefore leading to further increased hitting distance.

Moreover, stronger bats means more durability and are thereby less prone to catastrophic breakage which leads to improved life cycle economics. In fact composite bats have benign breakage which leads to a safer environment. It should also be noted that use of a wood type different from the ash wood now being used on a large scale and thereby depleted is a further advantage of the invention.

Stiffer bats also means more efficient energy transfer at the point of contact of the ball with the bat and therefore more power being delivered to the ball.

A polymer composite is an anisotropic material, since it exhibits different responses to stresses applied in different directions depending on how the fibers are arranged within the material. Materials such as metal and plastic, for example, are known as non-anisotropic materials. Thus, properties of bats made in accordance with the present invention, such as strength, stiffness and durability, can be controlled by altering the fiber direction of the polymer composite skin 14 with respect to the core 15. For example, it has been found advantageous by the applicant, for obtaining maximum strength, durability and stiffness, to place the fibers of skin or sleeve 14 at more or less +/−45 degrees to the longitudinal axis of core 15.

In preferred embodiments, the fiberglass braided material sleeve 14 used in covering the lightweight core is of the type having the following characteristics: fibers placed at more or less 45° to the longitudinal axis of the core 15, more or less 11.9 ounces per square yard resulting in a textured surface which in the handle portion 12 results in increased friction thereby in an improved grip and in the working portion 13 better ball contact meaning less slicing and hooking of the ball when in flight. Also, fiberglass braided material of any angle or having the following characteristics could be used: fibers placed at more or less 30° to the longitudinal axis of the core 15, more or less 17.2 ounces per square yard in place of the one aforementioned. Furthermore, the hand-lay up process used allows for improved overall appearance of the device with no seams or parting lines.

Generally, the braided materials used are selected from a group consisting of fiberglass, graphite, aramid, boron or hybrids of any of these since these are well suited and currently commercially available. Alternative to braided material could be knitted materials, woven materials or roving materials.

With respect to the lightweight core used one could alternatively use titanium or aluminum tubes, honey comb, foams or other lightweight woods.

As for the resin used to put and hold the braided material sleeve in close contact with the lightweight core a choice of epoxy, polyester, vinylester or thermoplastic could be used as they are well suited and commercially available.

Figure 3:
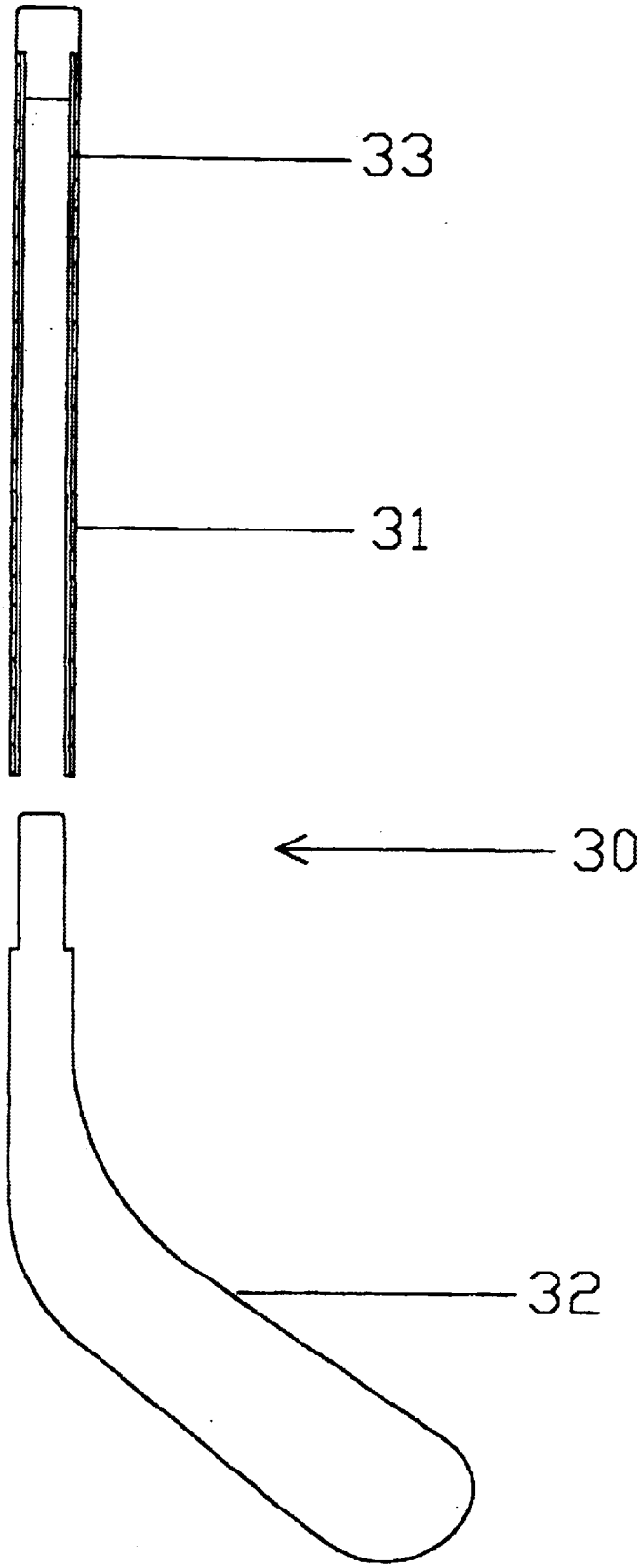
FIG. 3 shows partial cross-sectional view of a hockey stick in accordance with the invention.

As illustrated in FIG. 3, the wrapping of the braided materials does not have to be over the full length of the device, in this case a hockey stick (either for a forward or a goalie) generally indicated as 30. In this instance, the over-wrap composite is placed over the handle portion 31 for dampening and gripping purposes, as well as for stiffening and appearance purposes. Once again, the stiffer handle portion 31 means more efficient energy transfer and better durability. It could also be that the braided materials are applied to cover the full length of the hockey stick 30 shaft 33 i.e. the handle portion 31 and the blade portion (or working portion) 32.

Each of the devices to which the braided material is affixed to has shown marked improvement with the addition of one layer of braided material. In a further embodiment of the invention, multiple wrappings of braided materials could be applied, if there is a need, when making the device even stronger and stiffer.

Some of the devices which could use a light core and braided material combination in the context of the invention would include, without being exhaustive, cricket bats, lacrosse shafts, oars, paddles, field hockey shafts, tool handles and riot sticks.

TYPICAL SUMMARY RESULTS OF THE INVENTION

| Bat Construction | Relative Bat Weight | Relative Bat Speed | Relative Durability | Relative Cost |
|---|---|---|---|---|
| Wood (Ash) | highest | lowest | lowest | lowest |
| aluminum | in between | in between | highest | highest |
| first main preferred embodiment | lowest | highest | in between | in between |

Note: Some leagues have regulations whereas other leagues do not have such regulations limiting bat weights to no less than 5 ounces lower than the bat length. In this case, the preferred embodiment's weight can be increased to meet any regulatory requirement by increasing the length of the largest diameter of the bat, the area commonly called the "sweet zone" which is the optimal area within which to hit ball. For example, that zone could be lengthened from typically 9" to approximately 18". This will result in significantly improved batting performance, less breakage and can only be achieved via the innovations contained in the proposed invention.

During the manufacture of the over-wrapped device, a braided tubular sleeve 14 is formed from fibrous material by known, conventional textile manufacturing procedure which produces such braided textile articles. The braided tubular textile sleeve 14 is constructed so that it is stretchable along its tubular axis as well as laterally.

This sleeve 14 is snugly placed and spread over the area to be covered, thereby covering at least the handle portion of the device core 15.

Resin is then applied to the braided tubular sleeve 14 and the sleeve is then further stretched axially, if needed, so as to ensure that it conforms closely to the contours of the device core 15. Another possible way of proceeding it to apply the resin to the device core before placing the sleeve onto the device core.

The manner in which the resin is applied may involve any known appropriate method such as dipping the entire device core 15 and/or sleeve 14 directly into a resin material. Hand lay-up of the resin makes this process a low cost manufacturing process.

Once the sleeve 14 is securely positioned onto the device core 15, and excess resin removed, the resinous material with which the sleeve has been treated is cured either by drying, heating, air curing or by any other method suitable to the resinous material employed. A textured finish is thus possible. However, if desired, a smooth surface could be produced by employing a shrink wrap, vacuum bag, peel ply, or other similar techniques, or subsequent sanding and/or machining.

The present invention has been described in connection with the above hand-lay up manufacturing technique.

Although this is a preferred embodiment, the present invention may be performed using other processes such as filament winding, pultrusion, tube rolling, vacuum forming or compression molding.

Further main preferred embodiments of the present invention will now be described with reference to FIGS. 4*a*), 4*b*), 5 and 6.

Figure 4A:
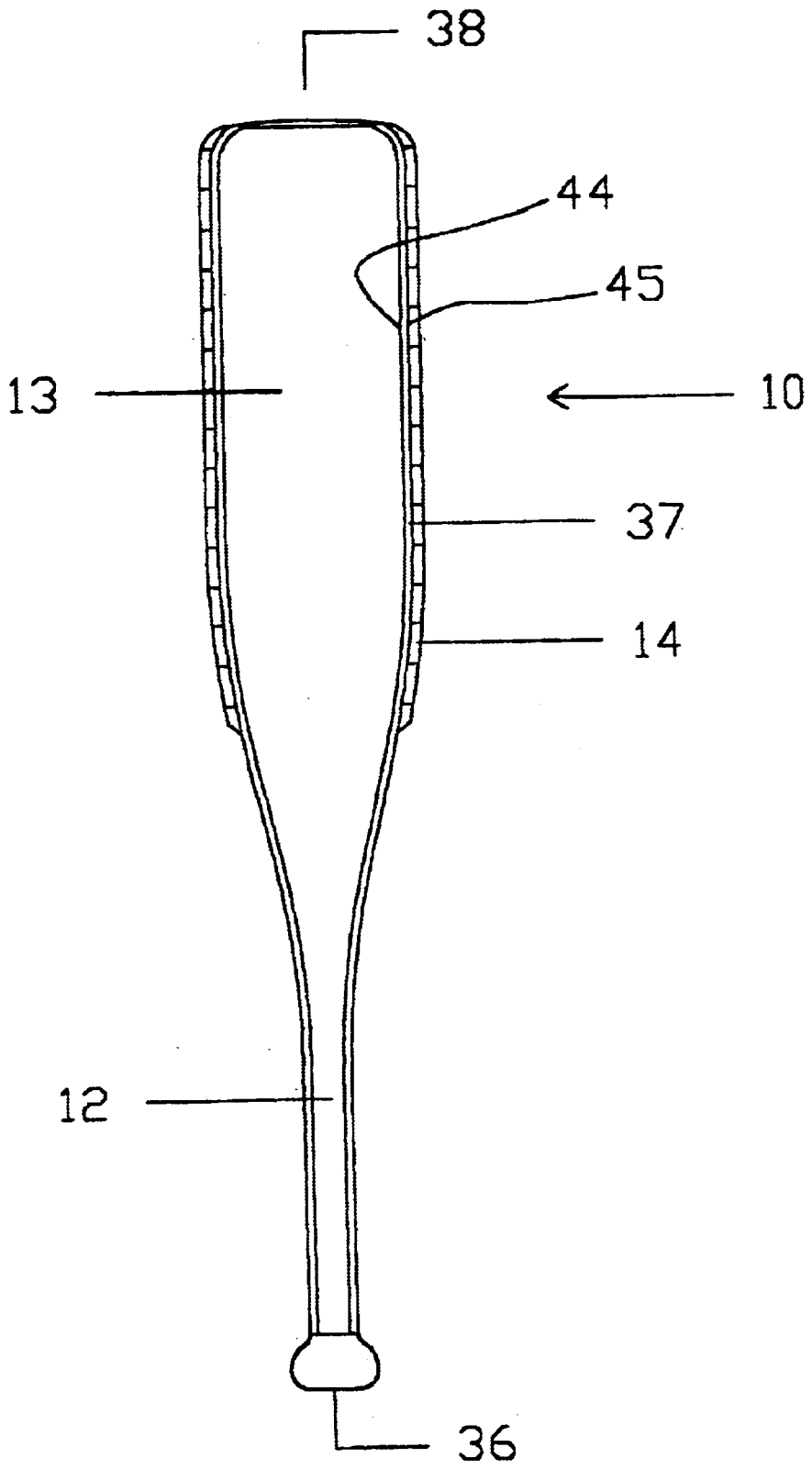
FIG. 4*a*) shows a longitudinal cross-section of a baseball bat in accordance with a preferred embodiment of the invention, having a tubular lightweight core made metal and a singular external polymer composite sleeve or skin directly bonded to the lightweight core in the striking portion only.
Figure 4B:
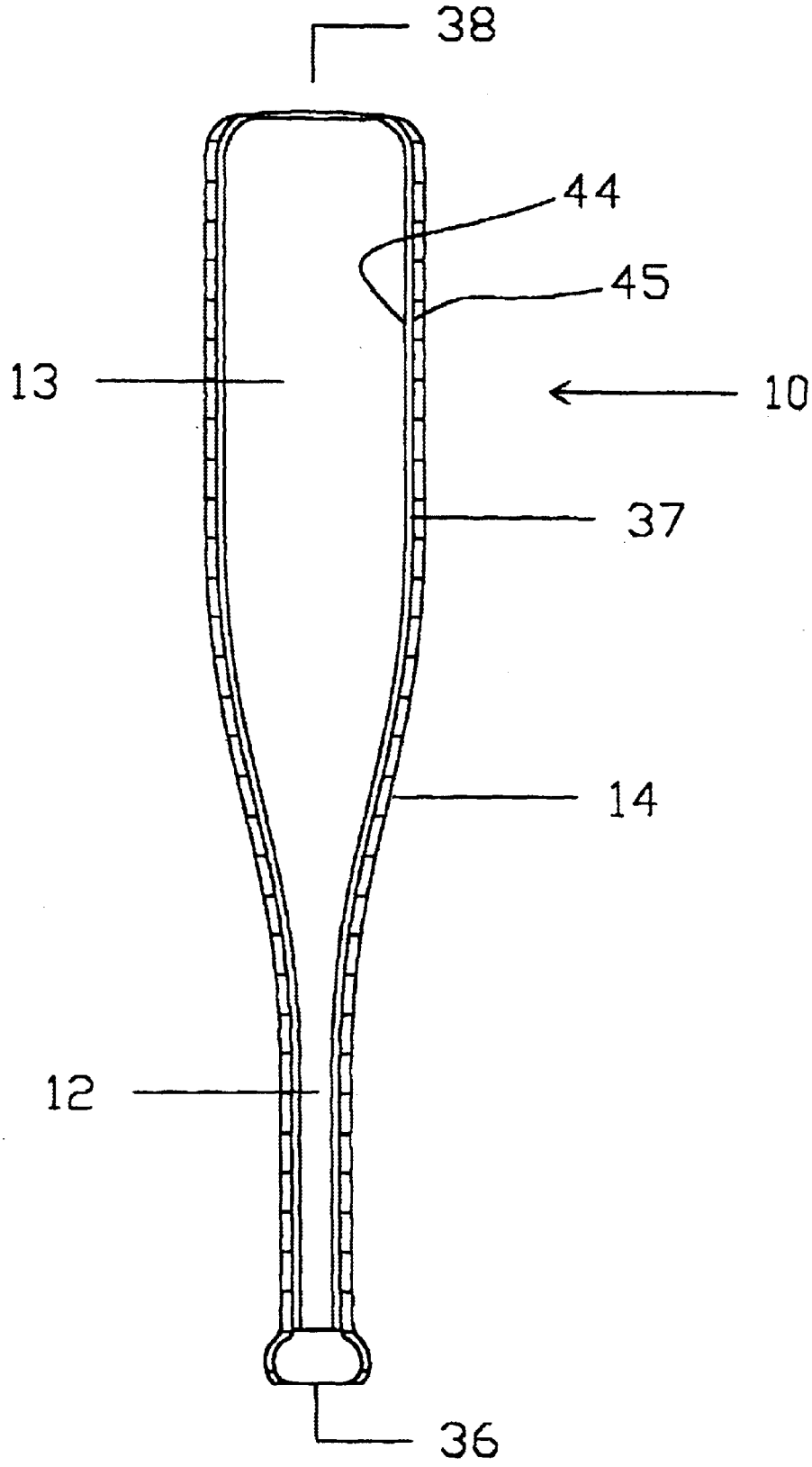
FIG. 4*b*) shows a longitudinal cross-section of the baseball bat of FIG. 4*a*) in which the polymer composite sleeve or skin covers both the striking portion and the handle portion.

FIGS. 4*a*) and 4*b*), show a second main preferred embodiment of baseball bat 10 of the present invention having a singular lightweight tubular metal core 37. Core 37 has an interior core surface 44 and an exterior core surface 45. Preferably, as shown in FIG. 4*a*), singular external polymer composite sleeve or skin 14 is formed over and bonded with a highly adhesive resin directly to only exterior core surface 45 of the working or striking portion 13 of core 37. Alternatively, as shown in FIG. 4*b*), external singular polymer composite sleeve or skin 14 may be formed over and rigidly bonded with resin to the exterior core surface 45 of both striking portion 13 and handle portion 12. In the further alternative, the external singular polymer composite sleeve or skin 14 may be bonded with resin only to the exterior core surface 45 of handle portion 12 (not shown).

The singular lightweight tubular metal core 37 is, for example, machined or otherwise formed to a desired shape, be it for adult or youth baseball or softball play. Metals such as aluminum and titanium have been found by the applicant to be effective in forming metal core 37 with aluminum being the preferred material. In this case, a knob 36 at the end of the handle portion 12 and a heel cap 38 at the end of the striking portion 13 may be made of plastic, composite, wood or metal and bonded or otherwise joined to the bat 10 at the ends. Polymer composite sleeve 14 may be formed over and bonded with resin to both the knob 36 and the heel cap 38 as well.

The wall thickness of tubular metal core 37 will vary from between 0.065 inches and 0.110 inches in the striking portion 13 and from between 0.080 and 0.085 inches in the handle portion 12, depending on the designated use for baseball bat 10. For example, for bats designed to be used in men's baseball, metal core 37 has a wall thickness of approximately 0.100 inches in the striking portion 13 and 0.085 inches in the handle portion 12. For women's fast pitch bats, metal core 37 typically has a thickness of 0.065 inches in the striking portion 13 and 0.080 inches in the handle portion 12.

The thin-walled construction of metal core 37 reduces the effective density of core 37 relative to a solid metal core. This lowers the weight of the core, but also reduces its mechanical properties such as strength and stiffness. However, the application of singular polymer composite sleeve or skin 14, having a thickness on the order of 0.040 inches, to the exterior of at least the striking portion 13 of core 37, establishes the above-described "structural sandwich" which results in a corresponding increase in bat strength, stiffness and durability. The density of aluminum used in constructing the applicant's bat in accordance with the present invention is on the order of 170 lbs/ft$^3$. The density of titanium used is on the order of 280 lbs/ft$^3$.

In this second main embodiment, as shown in FIGS. 4*a*) and 4*b*), the applicant has found that creating a "structural sandwich" by wrapping at least the striking portion 13 of core 37 with singular thin external polymer composite skin 14 around the bat, resulted in a lighter, stronger and stiffer bat offering improved dampening thereby reducing vibrations occasioned on contact with a baseball. Further, the sound produced by the impact of a ball upon baseball bat 10 of this embodiment is much preferable to the typical pinging sound produced by an all aluminum bat. Also, in field testing to date, durability has been markedly improved over traditional wood or aluminum bats, particularly with regard to breakage and surface depressions or dents. The improved durability is due to the strength of the polymer composite skin 14 and to the arrangement of fibers within the skin at an angle of more or less +/−45 degrees to the longitudinal axis of core 37.

The weight of the present invention compared to bats constructed of conventional materials is thus reduced without a comparable loss in either strength, stiffness or durability. In general, the weight of the bat in ounces is in the range of between three and sixteen ounces less than the length of the bat in inches. For example, 34 inch adult slowpitch softball bats made in accordance with this preferred embodiment weigh as little as 26 ounces, compared to similar length all-aluminum bats weighing 28 ounces, complex multi-layer composite bats weighing 31 to 34 ounces, and ash bats weighing 34 ounces. As another example, 32 inch youth baseball bats weigh as low as 16 ounces. Comparable length bats constructed of other materials have length to weight differentials that are considerably less than those noted above for the second main preferred embodiment of the present invention.

During construction, to enhance the quality of bonding, the exterior surface 45 of metal core 37 is roughened by mechanical abrasion prior to applying the polymer composite skin 14 using a variety of processes that will be familiar to those skilled in the art, such as hand lay up, filament winding, compression molding, resin transfer molding, and so forth, whereby the wet resin is allowed to impregnate the roughened surface and directly bond the polymer composite skin 14 to the tubular metal core 37.

In this preferred embodiment, the fiber to resin ratio in the polymer composite skin 14 is approximately 65:35. As for the braided materials, graphite fibers have been found to be particularly advantageous, although the other types of fibers mentioned, such as fiberglass, aramid, boron and hybrids thereof, can also be effectively used. In the case where graphite fibers have been used in conjunction with epoxy resin, the density of the resulting polymer composite skin 14 is on the order of 100 lbs/ft$^3$. In the case where fiberglass and epoxy resin is used, the resulting density of polymer composite skin 14 is on the order of 130 lbs/ft$^3$. As noted earlier, other types of resins that can be used include polyester, vinyl ester and thermoplastic. Also, as noted above, it has been found advantageous by the applicant, for obtaining maximum strength, durability and stiffness, to place the fibers of the polymer composite skin 14 at more or less +/−45 degrees to the longitudinal axis of core 37. This improves the trampoline effect achieved by the present embodiment which results in improved spring back of the metal core 37 following contact with a baseball which improves hitting performance, and reduces denting which improves durability.

During independent testing on two separate occasions, conducted by more than 1200 baseball players in each test rating bat performance, feel, balance and sound, this embodiment of the invention received the number one superior performance rating when compared to 12 other major competitive products. The rating achieved by the present invention was due mainly to the increased bat speed generated by the present invention, which in turn resulted in increased hitting distance. Further, the players rated the bat of this embodiment superior with respect to feel, balance and sound.

Figure 5:
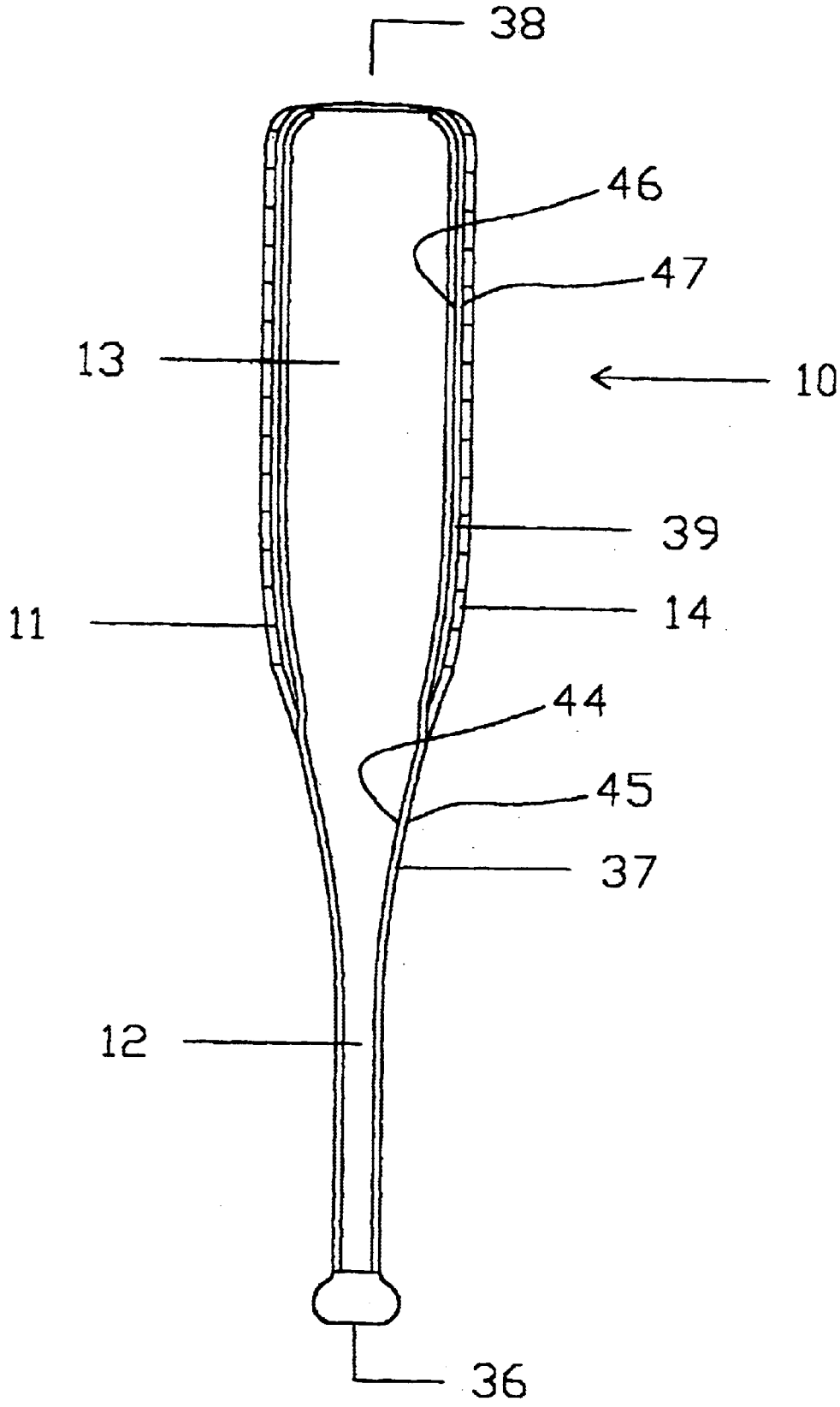
FIG. 5 shows a longitudinal cross-section of the baseball shown in FIG. 4*a*) in which the lightweight core has a double metal wall in the striking portion.

A variation of this second main embodiment of the present invention is shown in FIG. 5, which illustrates a lightweight metal tube 39 having an interior tube surface 46 and an exterior tube surface 47. Tube 39 is formed, by a swaging process, over the exterior surface 45 of striking portion 13 of tubular core 37, thus producing a double metal wall construction in the striking portion 13 of bat 10. In this case, as shown in FIG. 5, the singular polymer composite external sleeve or skin 14 covers and is rigidly bonded with a highly adhesive resin directly to only the exterior tube surface 47 of tube 39 in the striking portion 13. In the alternative, external polymer composite skin 14 may cover and be rigidly bonded with resin to both the exterior tube surface 47 in the striking portion 13 and the exterior core surface 45 in the handle portion 12 (not shown), or to the exterior core surface 45 in the handle portion 12 only (not shown).

In the variation of the present invention shown in FIG. 5, metal core 37 and metal tube 39 combine with external polymer composite skin 14 to form the above-described "structural sandwich" in the striking portion 13, thus increasing bat strength, stiffness and durability, while at the same time reducing weight. In addition to lowering weight, the combination of core 37 and tube 39 in the striking portion 13 enhances the trampoline effect which results in improved spring back following contact with a baseball which improves hitting performance, and reduces denting which improves durability.

The thicknesses of tube 39 and core 37 will vary depending on the designated use for baseball bat 10. For example, for a slow-pitch bat, core 37 will typically have a thickness of 0.047 inches in the striking portion 13 and 0.080 inches in the handle portion 12, and tube 39 will have a thickness of approximately 0.055 inches. The result is a total thickness of approximately 0.102 inches in the striking portion 13 and 0.080 inches in the handle portion 12. The total thickness of the double wall, comprising tube 39 and core 37 in the striking portion, will vary from between 0.065 inches and 0.110 inches, while the thickness of core 37 in the handle portion will vary from between 0.080 inches and 0.085 inches.

Tube 39 can be formed of aluminum or titanium with aluminum being the preferred material. All other features and characteristics of this variation of the second main embodiment of the invention, as shown in FIG. 5, are similar to those described for the second main embodiment, as shown in FIGS. 4*a*) and 4*b*).

Figure 6:
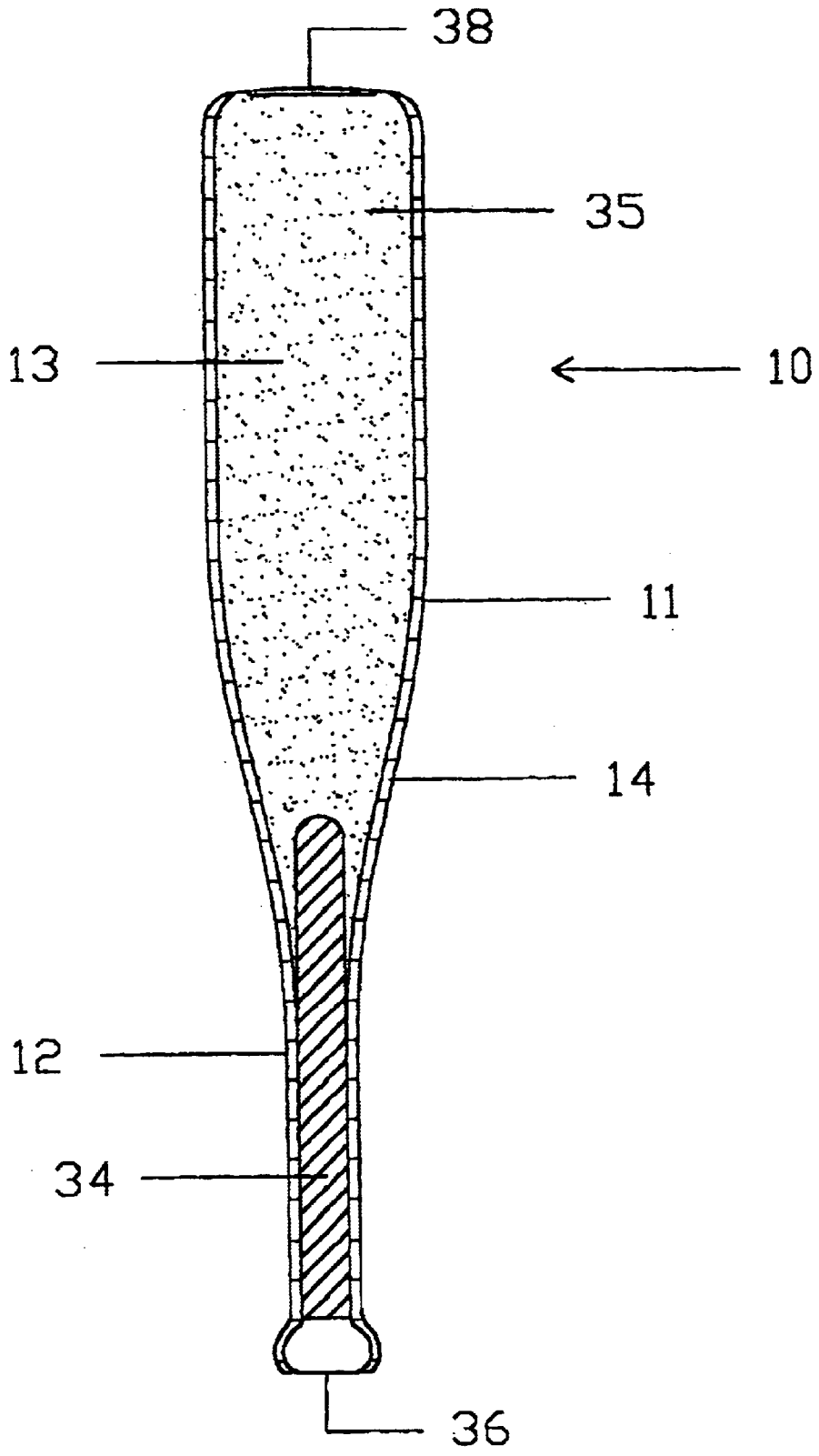
FIG. 6 shows a longitudinal cross-section of a baseball bat in accordance with a further preferred embodiment of the invention having a lightweight core made of a lightweight wood in the handle portion and a lightweight foam in the striking portion and a singular polymer composite sleeve or skin directly bonded to the lightweight core.

A third main preferred embodiment of the invention is shown in FIG. 6, which illustrates baseball bat 10 having a lightweight hardwood core 34 made of poplar or aspen in the handle portion 12 which is continuous with a lightweight foam core 35 in the striking portion 13. As shown, one end of wood core 34 is preferably, but not necessarily, extended into and encased by an opposing end of foam core 35. Advantageously (not shown in FIG. 6), core 34 could be extended into and encased by foam core 35 for up to the full length of striking portion 13. Alternatively, core 34 could be made of plastic.

External singular polymer composite sleeve or skin 14 is formed over and bonded directly to the exterior surface of the striking portion 13 and handle portion 12 of cores 34, 35. The wood and foam cores 34, 35 are machined and/or molded to a desired shape, be it for adult or youth baseball. In this case, knob 36 at the end of the handle portion 12 may be made of plastic, composite, wood or metal and bonded or otherwise joined to the handle portion 12. End cap 38, made of similar materials, may or may not be bonded or otherwise joined to the end of striking portion 13. Singular polymer composite sleeve 14 may be formed over and bonded to both the knob 36 and the heel cap 38 as well.

In the alternative, cores 34 and 35 may both be made of foam and may be comprised of a single solid piece of foam comprising a single solid foam core in both the handle portion and the striking portion, similar to that shown in FIG. 1 as lightweight core 15.

In the third main embodiment illustrated in FIG. 6, the applicant has found that creating a "structural sandwich" by wrapping both the striking portion 13 and the handle portion 12 with singular thin polymer composite sleeve or skin 14 around the bat, resulted in a lighter, stronger and stiffer bat offering improved dampening thereby reducing vibrations occasioned on contact with a baseball. For example, the resulting bat weighed between three and 18 ounces less than its length in inches. That is, a 30 inch bat weighted as low as 12 ounces, a differential of 18. This compares to a maximum differential of 10 for comparable sized traditional youth baseball bats, for an improvement of 80%. The lighter weight of the present invention results in faster bat speed and thus, improved hitting performance. Field testing conducted with youth baseball players using the embodiment of the invention shown in FIG. 6, resulted in faster bat speeds and increased hitting distances when compared to conventional traditional baseball bats.

In the embodiment shown in FIG. 6, the wood and foam cores 34, 35 are made of relatively weak porous materials whereby the wet epoxy resin soaks into cores 34, 35 resulting in increasing strength of the bat, and also, ensuring bonding of the polymer composite outer wrap 14 to the cores 34, 35. Also, the external polymer composite skin 14 encapsulates the wood and foam cores 34, 35 thereby preventing them from drying out and losing strength.

Polymer composite skin 14 preferably has a thickness on the order of 0.040 inches and in combination with the wood foam cores 34, 35 provides the above-described "structural sandwich" thereby improving bat strength, stiffness and durability. For maximum strength, stiffness and durability, fibers in polymer composite skin 14 are arranged at an angle of more or less +/−45 degrees to the longitudinal axis of cores 34, 35 and the fiber to resin ratio is approximately 65:35. Types of foam used to form core 35 include polystyrene, polyurethane, polyvinyl, polymethacrylimide, polyamide and syntactic. Typical foam densities for core 35 in the striking portion 13 range from approximately 5 lbs/ft$^3$ to 20 lbs/ft$^3$. Generally, aspen or poplar hardwoods are used to form wood core 34 in handle portion 12, having densities in the range of 26 to 30 lbs/ft$^3$.

The invention may be embodied in other specific forms without departing from the spirit or essential characteristics thereof. The present embodiments are therefore to be considered as illustrative and not restrictive, the scope of the invention being indicated by the appended claims rather than by the foregoing description, and all changes that come within the meaning and range of equivalency of the claims are therefore intended to be embraced therein.

I claim:

1. A baseball bat having an outermost striking surface comprising:

a singular lightweight core, wherein said core is a hollow void lightweight metal tube having an exterior core surface and an interior core surface, said core comprising:

a shaft having a longitudinal handle portion and a handle end portion at one end for manipulation by a user during use of the bat;

a longitudinal striking portion and a striking end portion at a second opposite end for striking by the user; and a singular external polymer composite skin covering and rigidly bonded with an adhesive resin directly to said exterior core surface of said striking portion and said handle portion of said core, said polymer composite skin comprising fibers impregnated with said resin and forming the outermost striking surface of the bat, said polymer composite skin having a thickness in the range of 0.04 inches, said metal tube having a wall thickness in the range of between 0.065 inches and 0.110 inches in said striking portion.

2. A baseball bat according to claim 1, wherein said metal tube and said polymer composite skin combine to form a structural sandwich.

3. A baseball bat according to claim 1, wherein said metal tube is made of material from the group consisting of aluminum and titanium.

4. A baseball bat according to claim 2, wherein said aluminum has a density on the order of 170 pounds per cubic foot and said titanium has a density on the order of 280 pounds per cubic foot.

5. A baseball bat according to claim 1, wherein said fibers are selected from the group consisting of fiberglass, graphite, aramid, boron and hybrids thereof, and said resin is selected from the group consisting of epoxy, polyester, vinyl ester and thermoplastic.

6. A baseball bat according to claim 1, wherein the ratio of fibers to resin is on the order of 65:35.

7. A baseball bat according to claim 1, wherein the weight of the bat in ounces is in the range of between three and sixteen ounces less than the length of the bat in inches.

8. A baseball bat according to claim 1, wherein said polymer composite skin has a density in the range of between 100 and 130 pounds per cubic foot.

9. A baseball bat according to claim 1, wherein said fibers are arranged at an angle of approximately +/−45 degrees to the longitudinal axis of said core in said striking portion.

10. A baseball bat according to claim 1, wherein said handle end portion includes a knob and said striking end portion includes a heel cap, and wherein said polymer composite skin covers and is rigidly bonded with said resin to, said knob and said heel cap.

* * * * *